United States Patent [19]

Bibbee et al.

[11] Patent Number: 4,963,400

[45] Date of Patent: Oct. 16, 1990

[54] METHOD AND APPARATUS FOR APPLYING A DRY FILM DRAWING LUBRICANT TO SHEET MATERIAL

[75] Inventors: Russell S. Bibbee; Robert E. Stearns, both of Fostoria, Ohio

[73] Assignee: Precision Carbide Die, Inc., Bloomdale, Ohio

[21] Appl. No.: 344,824

[22] Filed: Apr. 28, 1989

[51] Int. Cl.[5] ..... B05D 3/02

[52] U.S. Cl. ..... 427/374.1; 427/398.5; 118/64; 118/66; 118/69; 118/227; 118/249; 118/258

[58] Field of Search ..... 427/348, 374.1, 398.5; 118/227, 249, 258, 262, 672, 64, 66, 69

[56] References Cited

U.S. PATENT DOCUMENTS

| | | | |
|---|---|---|---|
| 2,966,425 | 12/1960 | Fucinari et al. | 427/327 |
| 3,070,459 | 12/1962 | Schaffer | 118/64 X |
| 4,237,816 | 12/1980 | Shimono et al. | 118/249 |
| 4,449,476 | 5/1984 | Voswinckel et al. | 118/419 |
| 4,867,097 | 9/1988 | Foltz | 118/407 |

*Primary Examiner*—Shrive Beck
*Assistant Examiner*—Alain Bashore
*Attorney, Agent, or Firm*—Marshall & Melhorn

[57] ABSTRACT

Method and apparatus for applying a dry-film drawing lubricant to metal blanks. Paired applicator and doctor rolls are positioned above and below the path of the sheets advancing through a roll box. The doctor rolls have end flanges overlapping the ends of the associated applicator rolls. A body of the liquid lubricant is maintained in the reservoir defined by each pair of applicator and doctor rolls, and following application of a coating of the lubricant to their surfaces, the blanks are conveyed between opposed heaters which raise the temperature of the coating to drive moisture therefrom. The blanks are conveyed between cooling units which lower the temperature of the lubricant coated surfaces, and thereafter through a transition zone to bring the temperature to the ambient range to prevent condensation thereon as the blanks are discharged to the atmosphere. The applicator rolls are mounted to automatically adjust to accommodate blanks of different thicknesses, and the doctor rolls are mounted for movement toward and away from the applicator rolls. A flushing system is provided for cleaning the applicator and doctor rolls at the end of a period of use.

27 Claims, 3 Drawing Sheets

METHOD AND APPARATUS FOR APPLYING A DRY FILM DRAWING LUBRICANT TO SHEET MATERIAL

BACKGROUND OF THE INVENTION

1. Field of the Invention

This invention pertains generally to the application of a drawing lubricant to the surface or surfaces of metallic sheet material, and more particularly to the application of a uniform coating resulting in a dry film of the drawing lubricant on the surface or surfaces.

2. Description of the Prior Art

Forming of metal parts by stamping or drawing metal sheets in many instances requires the presence of a lubricating film on the surface or surfaces of the sheets. Such lubricants were initially conventionally applied in liquid form by dipping blanks or continuous coil stock in a bath of the lubricant. This procedure has not proven entirely satisfactory in that it is time and labor consuming and often results in application of uneven coatings. The coated blanks or stock, inasmuch as the coating material remains in liquid form, are messy to handle and tend to create unpleasant, foul conditions throughout the working area and around the equipment within which they are fabricated and processed.

More recently, so-called dry-film lubricants have been employed wherein the film material is applied in a liquid or wet state, and then processed to a dry state prior to the actual metal forming operation. Such dry film lubricants are required for the more difficult drawing operations which require retention of the lubricating film through subsequent stages of the drawing process. They are available in both solid and liquid form. The solid form lubricant is heated to liquify it to permit application by conventional coating methods, and then cooled to again solidify. The liquid form lubricant, following application by traditional liquid coating techniques, is heated to insure removal of a majority of its liquid content in order to achieve a dry film. Drying of the liquid coating normally involves transporting the coated blanks on a conveyor line past heaters to accelerate evaporation of the liquid. A considerable amount of space is required for the conveyor system and heaters used in moving parts past the heaters, and excessive labor may be required for loading and unloading the conveyor as well as for transporting coated blanks to various press working locations throughout a plant.

There is disclosed in U.S. Pat. No. 2,614,526 a metal stock oiler comprising a sump, an upper tube and a lower tube each having perforations therein for spraying lubricant on both surfaces of the stock, and a pump for forcing the lubricant out through the apertures. Baffles are provided above and below the stock for confining lubricant within the device, and the stock passes between rollers after the lubricant is sprayed on its surfaces.

U.S. Pat. No. 2,966,425 discloses apparatus for applying metal working lubricants, and particularly dry lubricants, to sheet metal. The sheet passes between rubber rolls, each of which has an associated steel doctor roll. Pipes apply the coating composition to the rubber coating rolls in advance of its convergence with the doctor roll. Following coating, the sheet passes through a drying apparatus. U.S. Pat. Nos. 4,147,126 and 4,384,544 pertain to systems for applying a liquid coating simultaneously to both surfaces of a continuous web of material using a roller transfer procedure.

SUMMARY OF THE INVENTION

In accordance with the present invention, there is provided a method and apparatus for applying dry-film lubricant to metal blanks, which lubricants are supplied in a liquid state and which are converted to the dry state by evaporation of moisture following application to the blanks. More particularly, the apparatus comprises a roll box including upper and lower rubber-covered applicator rolls, each of which is in rolling contact with a steel doctor roll. The doctor rolls have end flanges which overlap the ends of the applicator rolls. Each applicator roll and doctor roll thus define a crotch therebetween which serves as a reservoir for containing virgin lubricant. The blanks pass between the applicator rolls whereupon a coating of the lubricant is applied to either one or both surfaces, and are then propelled from the nip of the applicator rolls onto a metal chain conveyor which quickly carries them into and through a high intensity heat chamber. The heat chamber raises the temperature of the lubricant coating and drives off the moisture. The blanks are then conveyed through a refrigeration chamber wherein the temperature of the lubricant is quickly reduced to the ambient range, after which the blanks are ready for the drawing operation. The temperature of the sheet is not significantly altered during the coating process, so that the surface hardness is unaffected. The coated sheet is discharged at a temperature below the melting point of the lubricant so that the lubricant is in a solid state, and at or above the ambient temperature to avoid condensation of moisture thereupon.

OBJECTS AND ADVANTAGES

It is, therefore, a primary object of the invention to provide an improved apparatus and method for applying a dry film drawing lubricant to metal sheets.

Another object of the invention is to provide such a system which minimizes the amount of lubricant required for forming the coating.

Another object of the invention is to provide such an apparatus which applies a uniform film of the lubricant of a selected controlled thickness.

Still another object of the invention is to provide such an apparatus which applies the film utilizing virgin lubricant, without recirculation of used material.

Still another object is to provide an apparatus which is compact, efficient and does not befoul the surrounding area with wasted lubricant.

Yet another object is to provide such an apparatus which is easily cleaned and deactivated at the end of a work period so as to be ready for immediate restarting at the beginning of the next work period.

Other objects and advantages of the invention will become more apparent during the course of the following description when taken in connection with the accompanying drawings.

BRIEF DESCRIPTION OF THE DRAWINGS

In the drawings, wherein like numerals refer to like parts throughout.

DESCRIPTION OF THE PREFERRED EMBODIMENT

Figure 1:
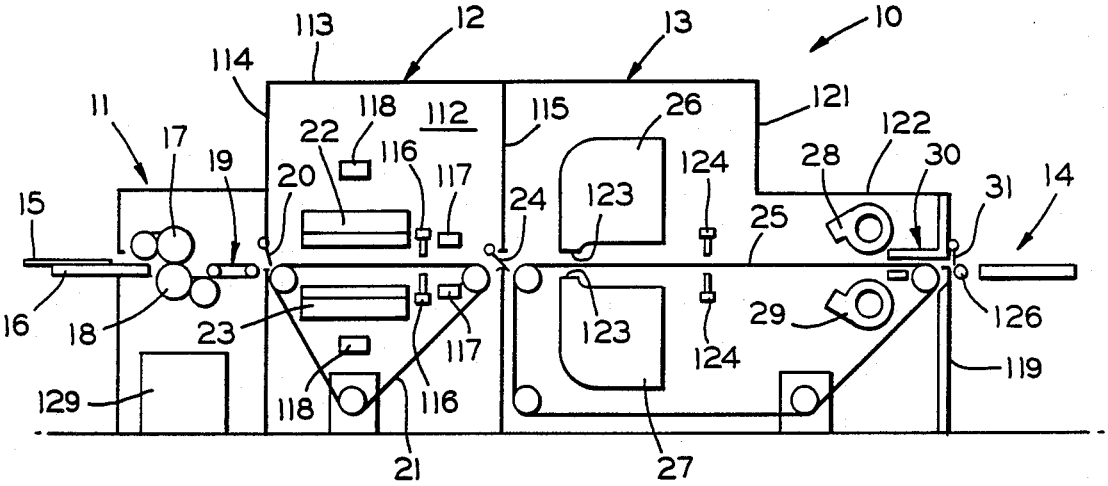
FIG. 1 is a schematic, longitudinal side view of the apparatus of the invention.

Referring now to the drawings, there is illustrated schematically at 10 in FIG. 1 a drawing lubricant coating apparatus in accordance with the invention. The apparatus includes a roll box or applicator section 11 wherein the lubricant is applied to either surface, or both surfaces, of sheets of material passing therethrough one after another. The coated sheets are conveyed into and through a heat chamber 12 where the lubricant film is heated to drive off moisture in a controlled manner, and then into and through an adjacent cooling chamber 13 where the temperature of the film is reduced to an ambient level prior to discharge of the sheet onto adjacent transfer means 14 for conveyance to subsequent stamping or drawing equipment (not shown).

More particularly, and again as best seen in FIG. 1, sheets 15 are deposited one at a time on a feed table 16 at the entrance to the coating device 10, and advanced between counter-rotating upper and lower applicator rolls 17 and 18, respectively, within the roll box 11. The coated sheets are received from the applicator rolls upon a chain link conveyor 19 which advances them beneath a hinged, self-closing barrier door 20 into the heat chamber 12. Within the heat chamber they are received upon and advanced by a continuous chain link-type conveyor belt 21 between suitably controlled upper and lower heating members 22 and 23, respectively. From the heat chamber the sheets pass beneath a second hinged barrier door 24 onto a chain link conveyor belt 25 within the cooling chamber 13. The conveyor belt 25 carries the sheets between upper and lower cooling units 26 and 27, respectively, and then between upper and lower blower units 28 and 29, respectively, defining a transitional temperature zone at the discharge end of the cooling chamber. The dry, lubricant-coated sheets are then conveyed through an exit lip arrangement 30 beneath a third hinged barrier door 31 onto the transfer means 14.

The novel roll box construction of the invention is particularly adapted to apply a uniform coating of virgin lubricant over the entire area of either or both surfaces of the sheets. No recirculation of used lubricant is involved, so that the lubricant does not become contaminated with debris from the surfaces of the sheets being coated. The applicator rolls adapt automatically to accommodate sheet material of different thicknesses, and provision is made for control of lubricant coating thickness. The lubricant supplied to the applicator rolls is confined within an enclosed reservoir so that little or no lubricant is lost to befoul the work area. A flushing system is included which, at the end of a run, washes remaining lubricant from the rolls and dumps any remaining residue to insure that the system will be free of dried residue and ready for immediate startup after a period of shutdown.

Figure 2:
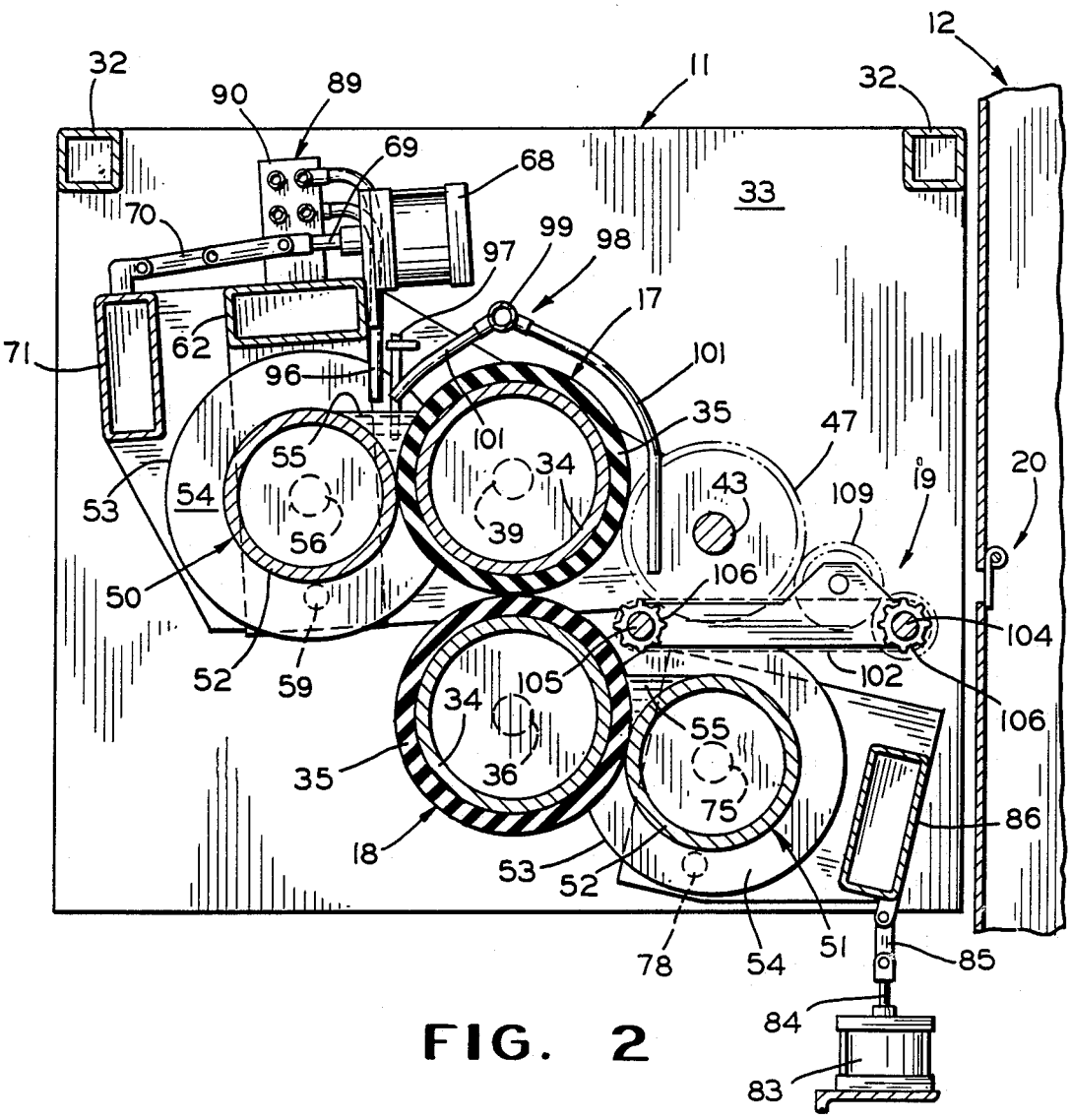
FIG. 2 is an enlarged vertical side view, partially in section, of the roll box section of the apparatus.
Figure 3:
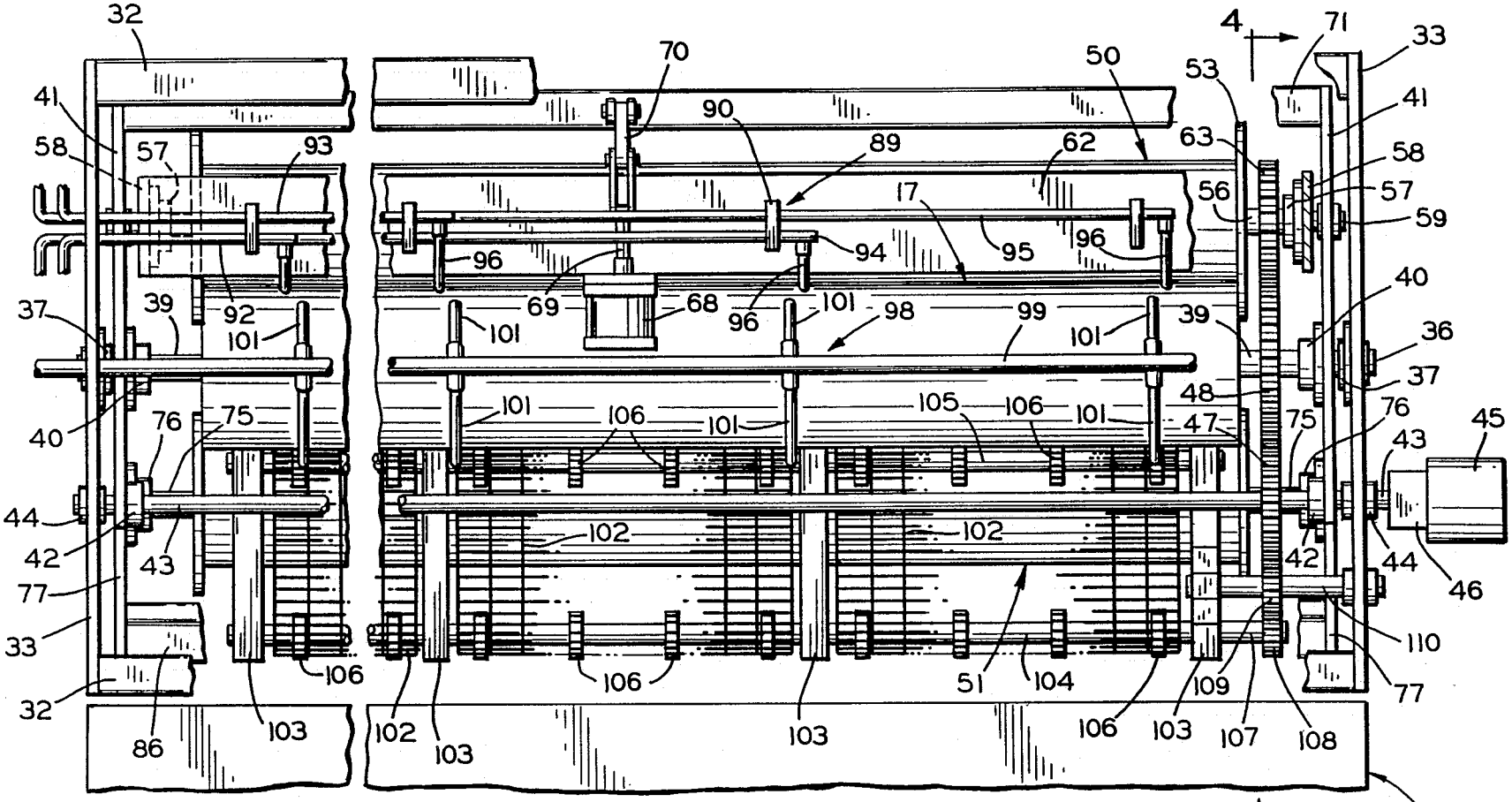
FIG. 3 is a top plan view of the roll box section of the apparatus.
Figure 4:
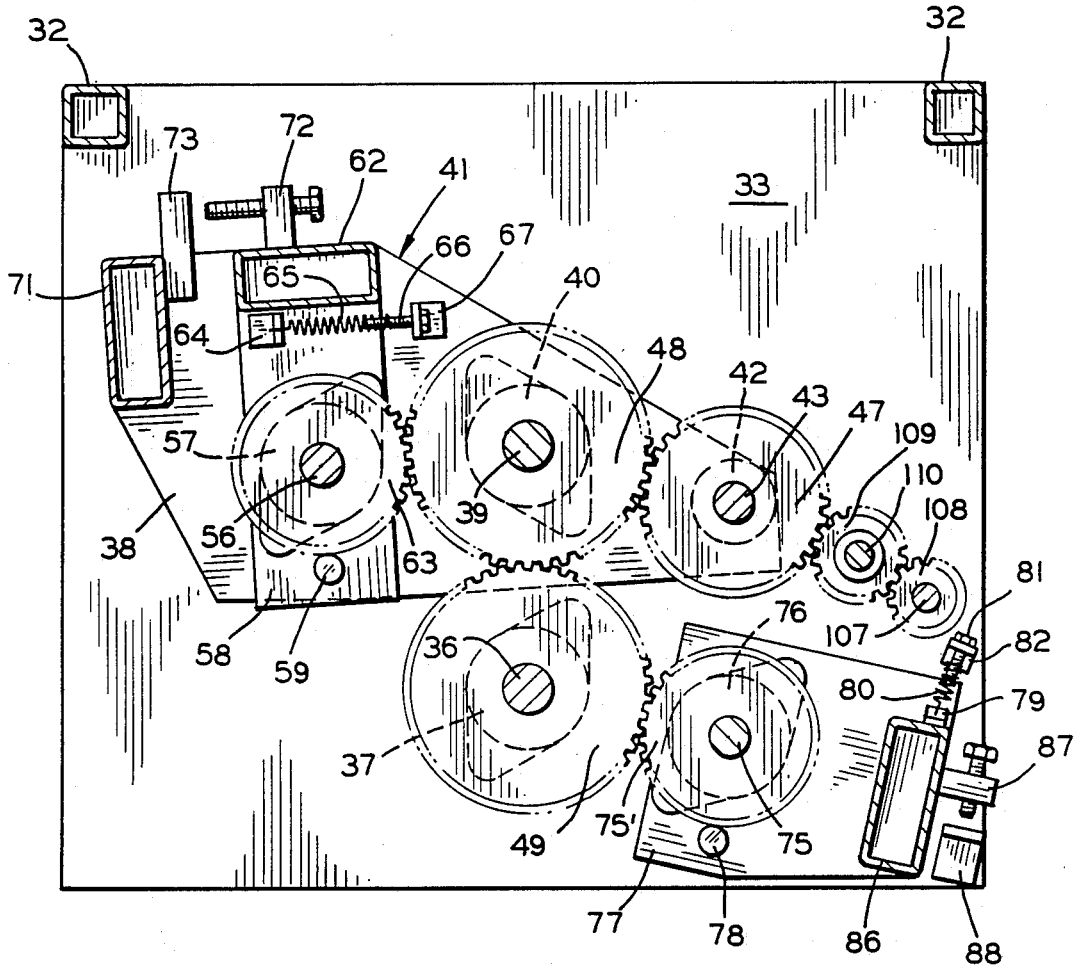
FIG. 4 is a vertical section taken substantially along line 4—4 of FIG. 3.

As best seen in FIGS. 2, 3, and 4, the roll box 11 more particularly comprises a suitable framework including transverse beams 32 and opposite end plates 33 defining a partial enclosure and providing support for the mechanism mounting the applicator rolls 17 and 18 and associated operating mechanism. The applicator rolls, as will be apparent in FIG. 2, include a cylindrical body 34 as of steel covered by a suitable resilient sleeve 35 as of rubber. As will be readily appreciated, inasmuch as the sleeve serves to transport and apply the lubricating liquid to the sheet surface, its composition, surface texture and hardness will, among other factors, relate to the thickness and uniformity of the film applied to the sheets. A non-porous, non-wicking, relatively hard rubber-type material has been found particularly suitable for this purpose.

The rolls 17 and 18 are mounted to accommodate sheets 15 of different thicknesses for passage therebetween. To that end, the lower roll 18 is provided at its ends with shafts 36 journalled in bearings 37 affixed to the end plates 33 so that the roll is mounted for rotation in a fixed position. The upper roll 17 is carried by a pivoting framework 38, and is provided with end shafts 39 journalled in bearings 40 carried by end brackets 41 of the pivoting framework. The framework 38, in turn, is mounted by bearings 42 for pivoting movement about a shaft 43 extending across the roll box and journalled for rotation in bearings 44 carried by the end plates 33. The upper roll 17 is thus adapted to float relative to the fixed lower roll 18 to accommodate passage of sheets 15 of different thicknesses therebetween.

Power to drive the mechanism within the roll box is provided as by means of a variable speed, reversible motor 45 connected through a gear reduction unit 46 to the shaft 43. A drive gear 47 fixed to the shaft 43 meshes with a gear 48 fixed to the end shaft 39 of the applicator roll 17. A gear 49 affixed to the shaft 36 meshes with the gear 48 to drive the lower applicator roll 18 in the direction opposite that of the roll 17 so as to convey the sheets 15 between the rolls. The teeth of the gears 48 and 49 are of sufficient depth as to remain meshed and in driving engagement as the roll 17 separates form the roll 18 to accommodate, within limits, variations in the thickness of the sheets being coated.

In order to supply the lubricant compound to the applicator rolls and assure delivery of a uniform coating to the sheets, there is provided in association with the rolls 17 and 18, doctor rolls 50 and 51, respectively. The doctor rolls are adapted to operate in rolling engagement with their associated applicator roll and define at their confluence a reservoir within which a body of the liquid lubricant is maintained. Thus, as best seen in FIGS. 2 and 3, each doctor roll comprises a tubular body 52 as of steel having a smooth outer surface for rotatably engaging the resilient sleeve 35 of the associated applicator roll. At each end of the tubular body there is provided a radial flange plate 53 whose inner surface 54 sealingly engages the end surface of the resilient sleeve 35. There is thus defined between the opposite flange plates at the confluence or crotch of the applicator roll and doctor roll a reservoir adapted to contain a body 55 of the liquid lubricant.

In order to permit adjustment of the contact pressure between the doctor roll and applicator roll for varying the amount of the lubricant coating carried by the applicator rolls, as well as to facilitate cleaning of the system, the doctor rolls are mounted for pivoting movement toward and away from their associated applicator roll. Thus, the upper roll 50 has end shafts 56 journalled in bearings 57 carried by brackets 58 at either side of the roll box. The brackets are pivotally mounted at 59 to spacer blocks 60 affixed to the end brackets 41 as by bolt 61 (FIG. 4). The opposite brackets 58 are interconnected at their top by a cross beam 62. A gear 63 affixed to the shaft 56 meshes with the gear 48 for driving the doctor roll in the direction counter to that of the applicator roll 17. In order to urge the doctor roll against the applicator roll, there is connected to each mounting bracket 58 as by an angle section 64 affixed thereto, a spring 65. A bolt 66 extending through a second angle section 67 affixed to the end bracket 41 is threadedly received by the spring. Thus, the pressure of the doctor roll against the applicator roll, and hence the lubricant carrying ability of the applicator roll, can be regulated by turning the bolts 66 to adjust the tension of the springs 65.

In order to pivotally retract the brackets against the urging of the springs 65 for separating the doctor rolls from the applicator rolls, as when flushing the roll system, there is affixed to the cross beam 62 a short stroke cylinder 68. The reciprocable piston 69 of the cylinder is connected by a suitable linkage 70 to a cross brace 71 extending between the end brackets 41. Thus, upon retraction of the piston the brackets 58 carrying the doctor roll 50 will be pivoted about the pivot mounting 59, against the urging of the springs 65, to disengage the doctor roll from the applicator roll. Adjustable stops 72 affixed to the cross beam 62 at either end are adapted to engage blocks 73 on the cross brace 71 for limiting the retraction of the doctor roll to insure that the gear 63 remains drivingly enmeshed with the gear 48.

The lower doctor roll 51 similarly includes shafts 75 journalled for rotation in bearings 76 carried by mounting plates 77. A gear 75' on the appropriate shaft 75 meshes with the gear 49 for driving the roll 51. The mounting plates are pivotally supported at 78 upon the end plates 33. In order to urge the doctor roll against the applicator roll there is connected to each mounting plate 77, as by an angle section 79 affixed thereto, a spring 80. A bolt 81 extending through a second angle section 82 affixed to the end plate 33 is threadedly received in the spring. The springs thus normally urge the doctor roll toward and into engagement with the applicator roll, and the pressure of the doctor roll against the applicator roll can be regulated by turning the bolts 81 to adjust the tension of the springs 80. As shown in FIG. 2, a short stroke cylinder 83 carried by the supporting framework of the machine (not shown) has its reciprocable piston 84 connected by suitable linkage 85 to a cross brace 86 extending between the mounting plates 77. Thus, by retracting the piston the mounting plates may be swung about the pivot supports 78 to disengage the doctor roll from the applicator roll. Adjustable stops 87 affixed to the cross brace 86 at either end engage brackets 88 on the end plates 33 for limiting retraction of the doctor roll by the cylinder.

In order to maintain the bodies of lubricant 55 within the reservoirs defined by the applicator and doctor rolls, there is provided a lubricant supply system, identified generally at 89. While for purposes of discussion such a system has been illustrated in FIGS. 2 and 3 only for the reservoir between the upper applicator and doctor rolls, it will be understood that a similar system is also provided for the reservoir between the lower rolls 18 and 51. More particularly, the supply system comprises a distribution manifold 90 mounted to receive the lubricant under pressure as from a pump (not shown) connected to a bulk source such as shipping drums (also not shown) stationed along side the device. The manifold 90 includes a plurality of outlets 91 (for example, four in the embodiment shown) with distributing lines 92, 93, 94, and 95 connected thereto. The distribution lines extend across the roll box above the reservoir 55, supported as on the cross beam 62. The lines terminate at spaced locations across the roll box in downwardly directed nozzle tubes 96 adapted to supply the liquid lubricant on demand to maintain the desired level in the reservoir. To that end, there is provided one or more suitable probes or sensors 97 which sense the level of the lubricant in the reservoir and signal the supply system 89 to replenish it as necessary. The probe further senses an unduly low level of lubricant, indicating a failure in the supply system, and alerts the operator to this condition and/or shuts the machine down to assure that inadequately coated sheets are not processed.

While the body of lubricant 55 within the reservoir will, of course, ultimately assume a level surface, the lubricant may be somewhat viscous, particularly where a relatively heavy coating is to be applied to the sheets. Discharging the lubricant into the reservoir from a number of nozzle tubes 96 spaced therealong assures that the proper level will quickly be reached and maintained, particularly during a startup period after the reservoir has been emptied and flushed. In order to further assure uniform distribution of the lubricant to the reservoir, provision is made for selectively regulating the flow to each of the nozzle tubes 96 individually as by means of a regulating valve (not shown) in the supply to each of the tubes.

For purposes of cleaning the reservoir and rolls in order to prevent formation of dried residue during periods of shut down as will be hereinafter described, there is provided a flushing system, identified generally at 98. The flushing system provides a suitable solvent and/or washing compound to the reservoirs between the applicator and doctor rolls following removal of the body of lubricant 55 therefrom, and may include a distribution pipe 99 suitably supported above the upper applicator roll 17 and extending across the roll box. Individual lines 101 spaced there along and extending in either direction therefrom are adapted to discharge the solvent, generally water, into the upper and lower reservoirs as will be apparent in FIGS. 2 and 3.

As the freshly coated sheets emerge from the applicator rolls, they are received upon the chain link conveyor 19 which propels them out of the roll box compartment beneath the hinged barrier door 20 into the enclosed cooling chamber 13. The conveyor may comprise a plurality of individual chain link belt sections 102 as shown in FIG. 3, and to that end includes suitably supported members 103 having forward and rear shafts 104 and 105, respectively, journalled therein. The shafts have a plurality of sprockets 106 spaced there along about which the belts 102 are entrained. The forward shaft includes an extension 107 to which a gear 108 is affixed. The gear 108 is enmeshed with an idler gear 109 rotatably carried by a shaft 110 suitably journalled at its ends. The idler gear, in turn, is enmeshed with the drive gear 47 for driving the forward shaft 104 and, consequently, the belt sections 102.

The heat chamber 12 comprises an enclosure including opposite side walls 112, a roof 113, a rear end wall 114 within which the barrier door 20 is located, and a forward end wall 115 common with the cooling chamber 13. The chain link conveyor belt 21 receives coated sheets from the conveyor 19 and carries them between the opposed heating members 22 and 23. The heating members are preferably of a type whose heat output can be controlled in response to the drying requirements of a particular combination of lubricant materials and thicknesses. For example, high intensity infrared lamps whose heat output is controlled by varying the voltage may suitably be employed for this purpose. To that end, there may be provided a conventional sensing unit or units 116 for observing the temperature of the lubricant film and regulating the output of the heating units in response thereto. Drying the film may, of course, also be controlled by varying the speed of the conveyor 21 carrying the parts through the chamber. Fans 117 are provided above and below the upper run of the conveyor 21 for extracting moisture-laden air from the chamber and initially reducing the temperature of the sheets upon emergence from the heating units. Additional fans 118 may be provided for removing excess heat from the enclosure above and below the heaters to extend their service life.

The cooling chamber 13 includes an enclosure defined by the opposite side walls 112, roof 113, common end wall 115, and an exit end wall 119. An intermediate end wall 121 and lowered roof section 122 define an exit section of reduced height at the exit end of the device. The cooling units 26 and 27 between which the sheets are conveyed upon the belt 25, have transversely extending discharge orifices 123 for blowing refrigerated air against the opposite surfaces of the sheets to quickly remove residual heat imparted to the sheet and carried into the cooling chamber. Temperature sensing units 124 may be provided above and below the conveyor belt for observing the temperature of the coated surfaces and regulating the cooling units accordingly to maintain the temperature within prescribed limits. The blowers 28 and 29 are adapted to blow ambient air onto the sheet surfaces and, with the exit section of reduced height and exit lip arrangement 30, create a transitional temperature zone at the exit end to ensure that the sheets are discharged substantially at ambient temperature so as to preclude condensation of moisture on their surfaces.

Figure 5:
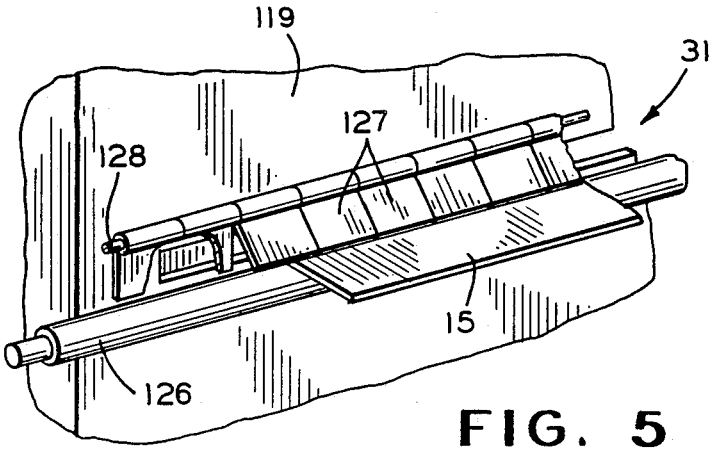
FIG. 5 is a fragmentary perspective view of the outlet from the apparatus.

As seen in FIG. 5, the sheets exit from the cooling chamber 13 through an opening 125 defined by the exit end wall 119, which is normally closed by the hinged barrier door 31, over an exit roll 126 and onto the transfer means 14. The door 31, as well as the doors 20 and 24 which are of similar construction, are adapted to minimize passage of air through the opening both when closed and when raised by an exiting sheet. To that end, the doors 20, 24 and 31 are preferably of the so-called piano hinge type and comprise a plurality of individual segments or flaps 127 swingably hingedly mounted end-to-end upon a hinge rod 128 carried by the associated wall. The sheets thus open only those segments within which they come into contact, and the free ends of the segments slide along the upper surface of the sheet and then drop back down to close the opening between passage of sheets.

A drainage tank 129 is provided within the roll box beneath the applicator and doctor rolls for use in flushing and cleaning the rolls as will be hereinafter explained.

Reviewing briefly operation of the invention, when the coating device is to be placed in service after a period of shutdown the pistons 69 and 84 of the cylinders 68 and 83 are extended, allowing the doctor rolls to move into engagement with the applicator rolls. Virgin lubricant is then admitted through the lubricant supply system by means of the nozzle tubes 96 to create the bodies of lubricant 55 within the reservoirs defined by the applicator and doctor rolls and the radial flange plates 53 of the doctor rolls. The heating units 22 and 23 are turned on and brought up to operating temperature, and the cooling units 26 and 27 are activated, as are the blower units 28 and 29. The applicator rolls and conveyors are activated and the sheets 15 are then fed to the applicator rolls. As the applicator rolls rotate in contact with the body 55 of lubricant and the doctor rolls, they have formed on their surface a uniform coating of the lubricant material. The applicator rolls, in turn, transfer a uniform continuous coating of the lubricant to the surfaces of the sheets 15 as they roll thereover. The coated sheets are then conveyed between the radiant heating units where the temperature of the lubricant is rapidly raised to a level on the order of 150° F. to drive the moisture therefrom without significantly increasing the temperature of the sheet material, thus assuring that its surface hardness is unaffected. The sheets then pass between the cooling units to lower the temperature of the lubricant coating to assure that it is below its melting point, and ultimately so that it approximately reaches the temperature of the ambient atmosphere before being discharged from the machine enclosure.

When the system is to be shut down for a period of time, the bodies of lubricant 55 are removed and the applicator and doctor rolls are cleansed to prevent formation of dried deposits which could interfere with proper operation upon startup following the period of shutdown. Thus, the level of the lubricant in the bodies 55 is allowed to drop to a minimum safe level for normal operation, and then operation is discontinued. The cylinders 68 and 83 are activated to pivot the doctor rolls away from the applicator rolls to allow the remaining lubricant to drain into the tank 129. The doctor rolls are returned to operative position, and liquid is admitted to the reservoirs by the flushing system 98. The lubricant material is generally an aqueous solution, and thus water may be employed as the flushing medium. However, other solvents and cleansing agents may used as well where appropriate. While the solvent or flushing medium is supplied to the reservoirs between the applicator and doctor rolls, the rolls are operated in the reverse direction. Solvent carried by the surfaces of the applicator rolls is squeezed from the roll surfaces by the doctor rolls. When all of the lubricant has thus been flushed from the system, any remaining solvent is dumped into the tank 129. The system is then clean and will be free of dried lubricant deposits and ready for immediate trouble-fee startup at any time.

It will thus be readily apparent that there is provided a system for applying a uniform coating of dry-film lubricant such as those commonly employed in the metal forming art and known as soap-based and wax-based lubricants. The sequential heating and cooling provides significant savings in time and space over existing dry-film applicators. The applicator rolls, due to their relationship with the flanged ends of the doctor rolls, are non-wicking so as to avoid undesirable excessive buildup of lubricant along the edges of the parts. The flanged end construction of the doctor rolls confines the lubricant to the reservoirs between the rolls so as to prevent spilling, thus avoiding the requirement for recirculation of lubricant. The consequent ability to use only virgin lubricant from the supply source eliminates contamination by residue on the sheets, and eliminates vaporation normally occurring during recirculation and consequent variation in the viscosity or solid/liquid ratio of the lubricant.

It is to be understood that the form of the invention herewith shown and described is to be taken as an illustrative embodiment only of the same, and that various changes in the shape, size and arrangement of parts, as well as various procedural changes, may be resorted to without departing from the spirit of the invention.

What is claimed is:

1. Apparatus for applying a film of a drawing and forming lubricant to a surface of a sheet of material comprising, in combination, a roll box section including at least one applicator roll adapted for rolling engagement with said surface for depositing said film of lubricant in liquid form on said surface, an enclosed heat chamber including therein means for radiantly heating said film to evaporate liquid therefrom without significantly raising the temperature of said sheet, an enclosed cooling chamber including means reducing the temperature of said film to a substantially ambient level, and means conveying said sheet successively through said roll box section, said heat chamber and said cooling chamber, whereby said lubricant film is essentially dry upon emergence of said sheet from said cooling chamber.

2. Apparatus for applying a film of a drawing and forming lubricant as claimed in claim 1, including a doctor roll mounted for rolling engagement with said applicator roll, said doctor roll including radial flanges at its ends overlapping the ends of said applicator roll in sealing engagement therewith, said applicator and doctor rolls and radial flanges defining a reservoir for containing a body of said lubricant.

3. Apparatus for applying a film of a drawing and forming lubricant as claimed in claim 2, including a pair of said applicator rolls positioned for passage of said sheet therebetween in rolling engagement with its opposite surfaces for depositing a said film on each surface.

4. Apparatus for applying a film of a drawing and forming lubricant as claimed in claim 1, wherein said roll box section, heat chamber and cooling chamber are contiguous, including narrow, elongated openings between said roll box section and said heat chamber, said heat chamber and said cooling chamber, and at the exit end of said cooling chamber, and a barrier door at each said opening, each said barrier door being normally closed and adapted to open in response to passage of said sheet therethrough by said conveying means.

5. Apparatus for applying a film of a drawing and forming lubricant to a surface of a sheet of material comprising, in combination, a roll box section including at least one applicator roll adapted for rolling engagement with said surface for depositing said film of lubricant in liquid form on said surface, an enclosed heat chamber including means heating said film to evaporate liquid therefrom without significantly raising the temperature of said sheet, an enclosed cooling chamber including means reducing the temperature of said film to a substantially ambient level, and means conveying said sheet successively through said roll box section, said heat chamber and said cooling chamber, whereby said lubricant film is essentially dry upon emergence of said sheet from said cooling chamber, wherein said roll box section, heat chamber and cooling chamber are contiguous, including narrow, elongated openings between said roll box section and said heat chamber, said heat chamber and said cooling chamber, and at the exit end of said cooling chamber, and a barrier door at each said opening, each said barrier door being normally closed and adapted to open in response to passage of said sheet therethrough by said conveying means, said barrier door comprising a plurality of hinged individual segments arranged end-to-end across said openings.

6. Apparatus for applying a film of a drawing and forming lubricant as claimed in claim 1, wherein said means heating said film comprises a radiant heat source, and including means observing the temperature of the heated film and regulating said radiant heat source in response to the observed temperature.

7. Apparatus for applying a film of a drawing and forming lubricant as claimed in claim 6, including fan means exhausting moisture laden air from said enclosed heat chamber.

8. Apparatus for applying a film of a drawing and forming lubricant as claimed in claim 1, wherein said means reducing the temperature of said film includes a refrigeration unit providing a source of conditioned air, and an orifice for directing said conditioned air against said lubricant film on said sheet.

9. Apparatus for applying a film of a drawing and forming lubricant as claimed in claim 8, including means observing the temperature of said film after said sheet passes said orifice and controlling said conditioned air in response to said observed temperature.

10. Apparatus for applying a film of a drawing and forming lubricant as claimed in claim 8, wherein said cooling chamber includes means defining a transition zone at its exit end, and blower means directing ambient air against said lubricant film within said transition zone whereby said sheet and lubricant film are at substantially ambient temperature so as to avoid condensation of moisture on said sheet as it exits from said cooling chamber.

11. Apparatus for applying a film of a drawing and forming lubricant as claimed in claim 1, wherein said conveying means comprises separate continuous open chain link conveyor belts, in each of said roll box, said heat chamber and said cooling chamber, the upper flights of said conveyor belts being longitudinally aligned for carrying sheets one after another from said applicator roll through said heat and cooling chambers.

12. Apparatus for applying a film of a drawing and forming lubricant as claimed in claim 3, wherein said applicator rolls are positioned one above the other, including means mounting the upper one of said applicator rolls for free movement toward and away from the lower one of said applicator rolls to accommodate passage therebetween of sheets of different thicknesses.

13. Apparatus for applying a uniform film of a drawing and forming lubricant to the opposite surfaces of sheet material comprising, a roll box including transversely extending opposed upper and lower applicator rolls mounted for rolling engagement with said opposite surfaces, means driving said applicator rolls in opposite directions for drawing said sheet material therebetween, a doctor roll adjacent each said applicator roll, each said doctor roll being mounted for rotation in engagement with its associated applicator roll, a radial flange on each end of each said doctor roll overlapping the corresponding end of said applicator roll and rotating in sealing engagement therewith, each said applicator roll and doctor roll with end flanges defining a reservoir for confining a body of said lubricant in liquid form, and means providing a continuous supply of said lubricant to said reservoir.

14. Apparatus for applying a uniform film of a drawing and forming lubricant to sheet material as claimed in claim 13, said upper applicator roll being mounted at its ends on brackets, and including means pivotally mounting said brackets whereby said upper applicator roll moves freely toward and away from said lower applicator roll to accommodate sheets of different thicknesses therebetween.

15. Apparatus for applying a uniform film of a drawing and forming lubricant to sheet material as claimed in claim 13, wherein said means providing said lubricant comprises a plurality of nozzle tubes disposed at spaced locations along said reservoir for depositing lubricant in said reservoir, and means supplying said lubricant to each said nozzle tube.

16. Apparatus for applying a uniform film of a drawing and forming lubricant to sheet material as claimed in claim 15, including valve means for individually regulating the flow of said lubricant to each said nozzle tube.

17. Apparatus for applying a uniform film of a drawing and forming lubricant to sheet material as claimed in claim 15, including sensor means adapted to monitor said lubricant in said reservoir and regulate delivery of said lubricant to said nozzle tubes to maintain said lubricant at a predetermined level.

18. Apparatus for applying a uniform film of a drawing and forming lubricant to sheet material as claimed in claim 17, wherein said sensor means is adapted to detect a below-minimum level of said lubricant in said reservoir and generate a signal stopping said applicator rolls in response thereto.

19. Apparatus for applying a uniform film of a drawing and forming lubricant to sheet material as claimed in claim 13, wherein said applicator rolls comprise a tubular cylindrical body covered by a durable resilient sleeve, said sleeve extending to the ends of said tubular body for sealingly engaging the inner surfaces of said radial end flanges of said doctor rolls.

20. Apparatus for applying a uniform film of a drawing and forming lubricant to sheet material as claimed in claim 13, said doctor rolls being journalled at their ends on brackets mounted for pivoting movement of said doctor rolls toward and away from their associated applicator roll, and including spring means urging said doctor rolls into engagement with said applicator rolls.

21. Apparatus for applying a uniform film of a drawing and forming lubricant to sheet material as claimed in claim 20, including means for selectively adjusting said spring means to regulate the pressure between said doctor and applicator rolls, and cylinder means operable to selectively retract said doctor rolls from said applicator rolls against the urging of said springs to separate said rolls for dumping liquid from said reservoirs.

22. Apparatus for applying a uniform film of a drawing and forming lubricant to sheet material as claimed in claim 21, including means for supplying solvent to said reservoirs for cleaning said rolls and flushing residue of said lubricant from said reservoirs following dumping of said lubricant from said reservoirs.

23. Apparatus for applying a uniform film of a drawing and forming lubricant to sheet material as claimed in claim 21, including intermeshing drive gears on associated applicator and doctor rolls, and stop means for limiting the retraction of said doctor roll from said applicator roll to maintain said drive gears in intermeshed relationship.

24. Apparatus for applying a uniform film of a drawing and forming lubricant to sheet material as claimed in claim 13, including a table positioned for feeding said sheet material between said upper and lower applicator rolls, and a conveyor comprising an open chain link-type web positioned for receiving and advancing the coated sheet material from said upper and lower applicator rolls.

25. A method of applying a dry-film drawing and forming lubricant to the surface of sheet material comprising, rolling an applicator roll having thereon a uniform layer of the liquid lubricant over said sheet material surface to transfer a coating of said lubricant to said surface, applying radiant heat to said coating of lubricant within an enclosure to raise the temperature of said coating to a predetermined level and evaporate the liquid solvent therefrom without significantly raising the temperature of said sheet material, directing conditioned air against said coating within a second enclosure to lower the temperature of said coating substantially to that of the ambient atmosphere, and advancing said sheet material out of said second enclosure to said ambient atmosphere whereby condensation of moisture on said coating is avoided.

26. A method of applying a dry-film drawing and forming lubricant as claimed in claim 25, including the step of regulating the application of heat to said coating of lubricant in response to the observed temperature of an immediately preceding heated coated area.

27. A method of applying a dry-film drawing and forming lubricant as claimed in claim 25, wherein a coating of said lubricant is applied to both surfaces of said sheet material.

* * * * *